US007654416B2

(12) United States Patent
Buining et al.

(10) Patent No.: US 7,654,416 B2
(45) **Date of Patent: *Feb. 2, 2010**

(54) FLUID AND HAIR-DYE DISPENSERS

(75) Inventors: Eric Buining, Rossum (NL); Wilhelmus Quirinus Laurentinus van Westerop, Noordwijk (NL); Leen Hellenberg, Warmond (NL); Johannes Hendrikus Mink, Noordwijkerwhout (NL)

(73) Assignee: Stibbe Management BV, Laren (NL)

( * ) Notice: Subject to any disclaimer, the term of this patent is extended or adjusted under 35 U.S.C. 154(b) by 219 days.

This patent is subject to a terminal disclaimer.

(21) Appl. No.: 11/277,159

(22) Filed: Mar. 22, 2006

(65) Prior Publication Data

US 2006/0169718 A1 Aug. 3, 2006

Related U.S. Application Data

(63) Continuation-in-part of application No. 11/065,915, filed on Feb. 25, 2005, now Pat. No. 7,121,430.

(60) Provisional application No. 60/548,682, filed on Feb. 27, 2004.

(51) Int. Cl.
*B67D 5/60* (2006.01)

(52) U.S. Cl. ..... 222/144; 222/135; 222/144.5

(58) Field of Classification Search ..... 222/144, 222/144.5, 135

See application file for complete search history.

(56) References Cited

U.S. PATENT DOCUMENTS

| | | | | |
|---|---|---|---|---|
| 2,374,430 | A | | 4/1945 | Hexter |
| 2,787,402 | A | | 4/1957 | Stiner |
| 2,848,019 | A | | 8/1958 | Corbin et al. |
| 2,975,939 | A | | 3/1961 | Russell et al. |
| 3,015,415 | A | | 1/1962 | Marsh et al. |
| 3,066,830 | A | | 12/1962 | Heiss et al. |
| 3,074,597 | A | | 1/1963 | Felts |
| 3,122,272 | A | * | 2/1964 | Marsh ..... 222/26 |
| 3,269,605 | A | * | 8/1966 | Silver ..... 222/135 |
| 4,027,785 | A | | 6/1977 | Edstrom et al. |
| 4,134,689 | A | | 1/1979 | Ahrenskou-Sorensen |
| 4,637,527 | A | | 1/1987 | Arrigoni |
| 4,681,741 | A | | 7/1987 | Hanaway |
| 4,813,785 | A | | 3/1989 | Miller |
| 4,891,185 | A | * | 1/1990 | Goldin ..... 422/69 |

(Continued)

FOREIGN PATENT DOCUMENTS

| | | |
|---|---|---|
| EP | 0461371 | 8/1994 |

(Continued)

*Primary Examiner*—Frederick C. Nicolas
(74) *Attorney, Agent, or Firm*—Adam K. Sacharoff; Much Shelist

(57) ABSTRACT

In accordance with the present invention there is provided a dispenser apparatus for dispensing fluids. The dispenser apparatus includes a centrally located vertically mounted column assembly. A plurality of canisters is cantilever mounted to the column assembly. Each canister has a receptacle for holding a fluid and each receptacle includes a corresponding pump for dispensing fluid held therein. The dispenser apparatus also includes a stationary dispensing station having a mechanism for selectively actuating the pump for dispensing fluid held in the receptacle. A mechanism is also provided for engaging a portion of a canister to align a pump corresponding to a receptacle to the stationary dispensing station, wherein the fluid held in the receptacle may be dispensed.

11 Claims, 6 Drawing Sheets

U.S. PATENT DOCUMENTS

| | | | | |
|---|---|---|---|---|
| 4,967,938 | A * | 11/1990 | Hellenberg | 222/144 |
| 5,078,302 | A | 1/1992 | Hellenberg | |
| 5,119,973 | A | 6/1992 | Miller et al. | |
| 5,268,620 | A | 12/1993 | Hellenberg | |
| 5,356,041 | A | 10/1994 | Hellenberg et al. | |
| 5,474,211 | A | 12/1995 | Hellenberg | |
| 5,558,251 | A * | 9/1996 | Neri | 222/135 |
| 5,647,411 | A | 7/1997 | Koppe et al. | |
| 5,711,458 | A | 1/1998 | Langeveld et al. | |
| 5,711,601 | A | 1/1998 | Thomas et al. | |
| 5,855,626 | A | 1/1999 | Wiegner et al. | |
| 5,904,421 | A | 5/1999 | Mazzalveri | |
| 5,906,433 | A | 5/1999 | Mazzalveri | |
| 5,938,080 | A | 8/1999 | Haaser et al. | |
| 5,992,691 | A | 11/1999 | Post et al. | |
| 6,003,731 | A | 12/1999 | Post | |
| 6,056,158 | A | 5/2000 | Rossetti | |
| 6,089,408 | A | 7/2000 | Fox | |
| 6,164,497 | A | 12/2000 | Chia | |
| 6,164,499 | A | 12/2000 | Chia | |
| 6,273,298 | B1 * | 8/2001 | Post | 222/105 |
| 6,360,961 | B1 | 3/2002 | Marazzi | |
| 6,398,513 | B1 | 6/2002 | Amsler | |
| 6,457,607 | B1 | 10/2002 | Andrea | |
| 6,540,486 | B2 | 4/2003 | Amsler | |
| 6,612,821 | B1 | 9/2003 | Kuijpers | |
| 6,793,387 | B1 * | 9/2004 | Neas et al. | 366/160.4 |
| 6,935,386 | B2 | 8/2005 | Miller et al. | |
| 6,991,004 | B2 | 1/2006 | Kaufhold | |
| 7,347,344 | B2 * | 3/2008 | Engels et al. | 222/144 |
| 2004/0262330 | A1 | 12/2004 | Voskuil | |
| 2005/0087545 | A1 * | 4/2005 | Engels et al. | 222/1 |
| 2005/0092772 | A1 | 5/2005 | Miller | |
| 2005/0247730 | A1 | 11/2005 | Post | |
| 2005/0252934 | A1 | 11/2005 | Miller | |
| 2005/0269367 | A1 | 12/2005 | Post | |

FOREIGN PATENT DOCUMENTS

| | | |
|---|---|---|
| EP | 0788831 | 8/1997 |
| EP | 0813901 | 12/1997 |
| EP | 1090679 | 4/2001 |
| EP | 1090679 A1 * | 4/2001 |
| EP | 1134186 | 9/2001 |
| EP | 0800858 | 7/2002 |
| EP | 1600678 | 11/2005 |
| FR | 1340860 | 10/1963 |
| WO | WO0205968 | 1/2002 |
| WO | WO03/082452 | 10/2003 |
| WO | WO03083306 | 10/2003 |
| WO | WO03090914 | 11/2003 |
| WO | WO2004029454 | 8/2004 |
| WO | WO2005107933 | 11/2005 |

* cited by examiner

FLUID AND HAIR-DYE DISPENSERS

This application is a Continuation-in-Part of U.S. Nonprovisional application Ser. No. 11/065,915 filed Feb. 25, 2005, which claims the benefit of Provisional Application No. 60/548,682 filed Feb. 27, 2004, both of which are incorporated by reference.

BACKGROUND OF THE INVENTION

In Assignee's prior filed application U.S. application Ser. No. 11/065,915, there was disclosed novel Fluid dispensers, which use colorants or dyes to obtain a desired color. As was previously disclosed, the unique automatic fluid dispenser is easy to operate and provides precision mixing of a large number of colorants or dyes to make an almost infinite number of colors. The machines are relatively light in weight, easy to operate and maintain and the various components can be readily and easily replaced. This is principally due to the fact that the canisters are supported by a column assembly and the conventional use of a massive turntable supporting the canisters has been eliminated.

SUMMARY OF THE INVENTION

As disclosed in the previous application, a dispenser apparatus is provided and includes a plurality of dispensing units or canisters. Each dispensing unit has a receptacle for holding a fluid (such as paint colorants or hair dyes) and each receptacle has a corresponding pump for dispensing fluid held in the receptacle. The dispensing units are preferably cantilever-mounted to a vertical mounting assembly that support the dispensing units (eliminating the turntable). The dispensing units are engaged by a mechanism that moves the dispensing units such that a pump corresponding to a receptacle can be moved to a stationary dispensing station. The dispensing station has the ability to actuate the pump in order to dispense fluid.

In accordance with the present invention there is provided an embodiment built upon the disclosure of U.S. application Ser. No. 11/065,915. The vertical mounting assembly includes a vertical support column and includes bearing mounts to hold and support a radial inward side defined on the dispensing units. The bearing mounts are secured to the support column such that the dispensing units may move around the column.

BRIEF DESCRIPTION OF THE DRAWINGS

Other features and advantages will be clear from the following drawings in which.

DETAILED DESCRIPTION OF THE INVENTION

Figure 1:
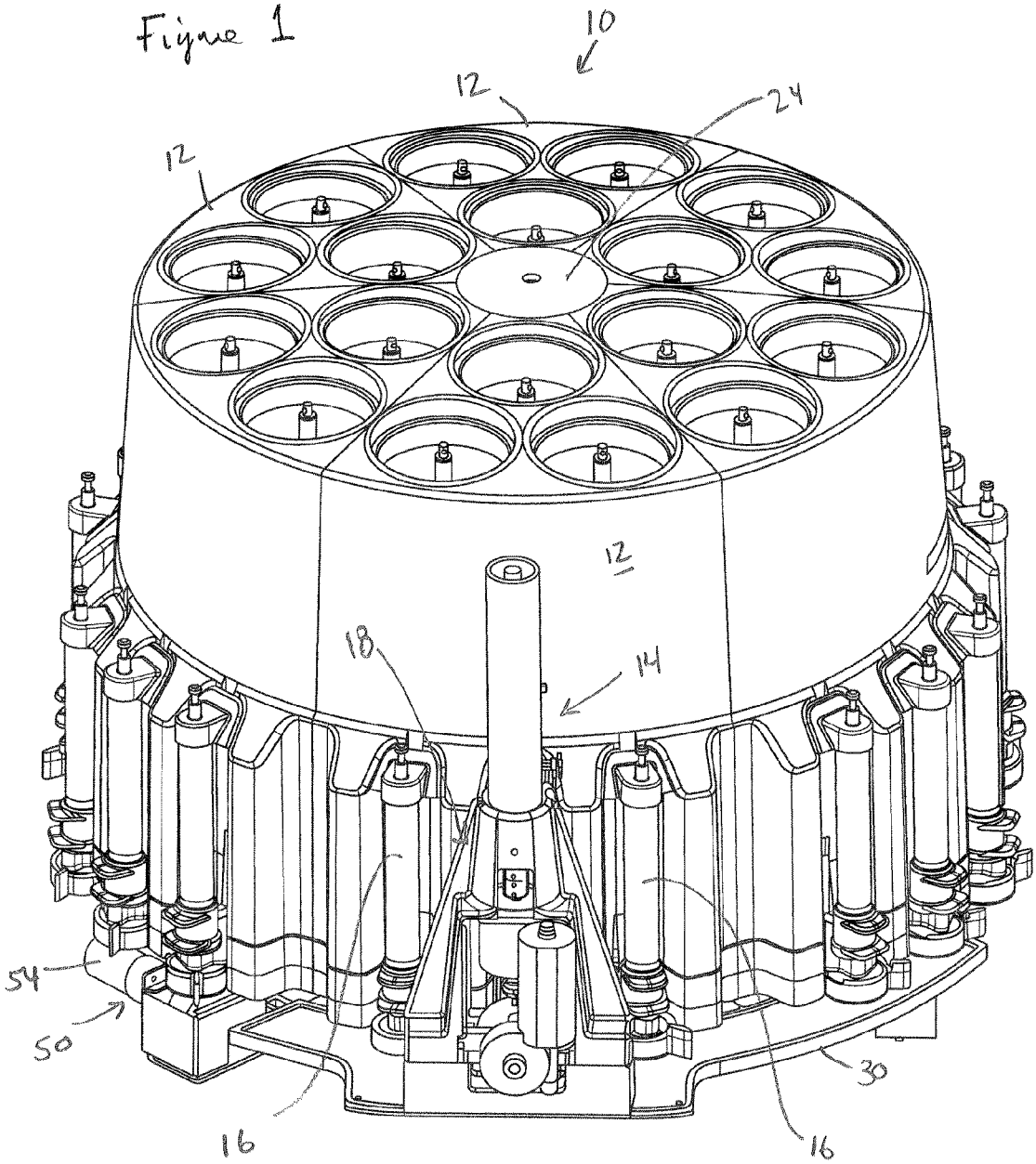
FIG. 1 is a perspective view of an automatic fluid dispenser.

Referring now to the drawings there is shown in FIG. 1 a perspective view of a dispensing apparatus in accordance with the invention, which apparatus in its entirety is indicated generally by reference numeral 10. The dispenser 10 is comprised of a series of canisters 12 that are centrally mounted and rotated to be positioned in front of a dispensing station 14 where quantities of fluid, such as colorants or dyes, are dispensed from the canisters 12. It is understood that other types of fluids or materials besides colorants can be dispensed such as inks, food, or other liquids as may be required. Each of the canisters 12 has at least one pump 16 connected thereto. The dispensing station 14 includes actuating assembly 18 to set the quantity of the fluid to dispense and includes various control mechanisms to operate the pumps 16 and associated valves (not shown) to dispense the precise amount. For the input and output of data a touch-screen (not shown) may be used. Each of the aforementioned components will be described in detail hereinafter.

Figure 3:
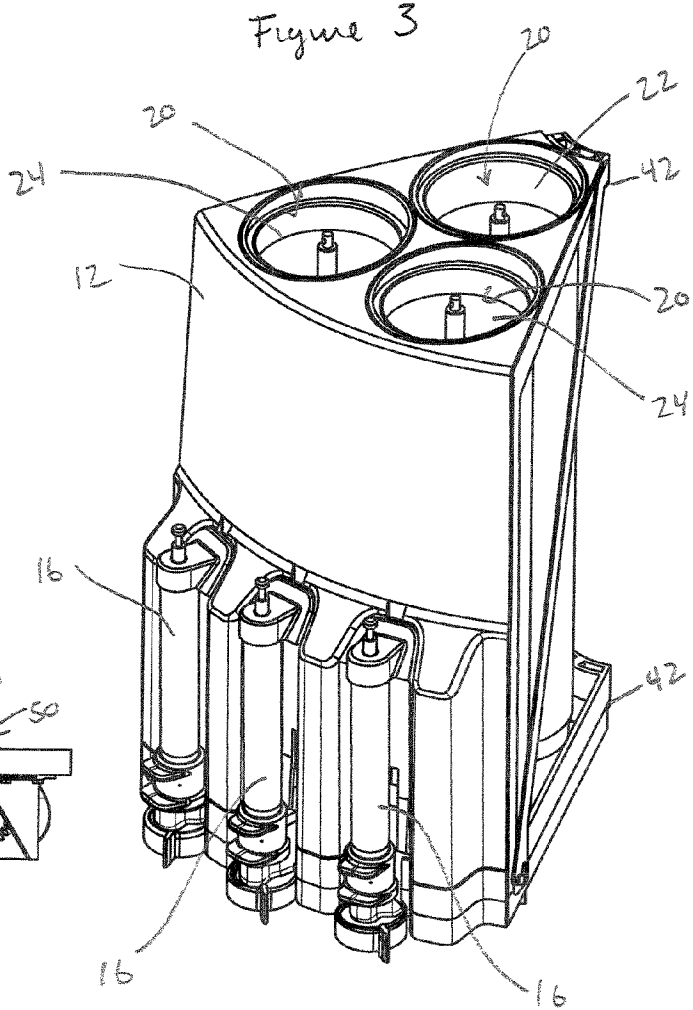
FIG. 3 is a front perspective view of a canister segment.
Figure 2:
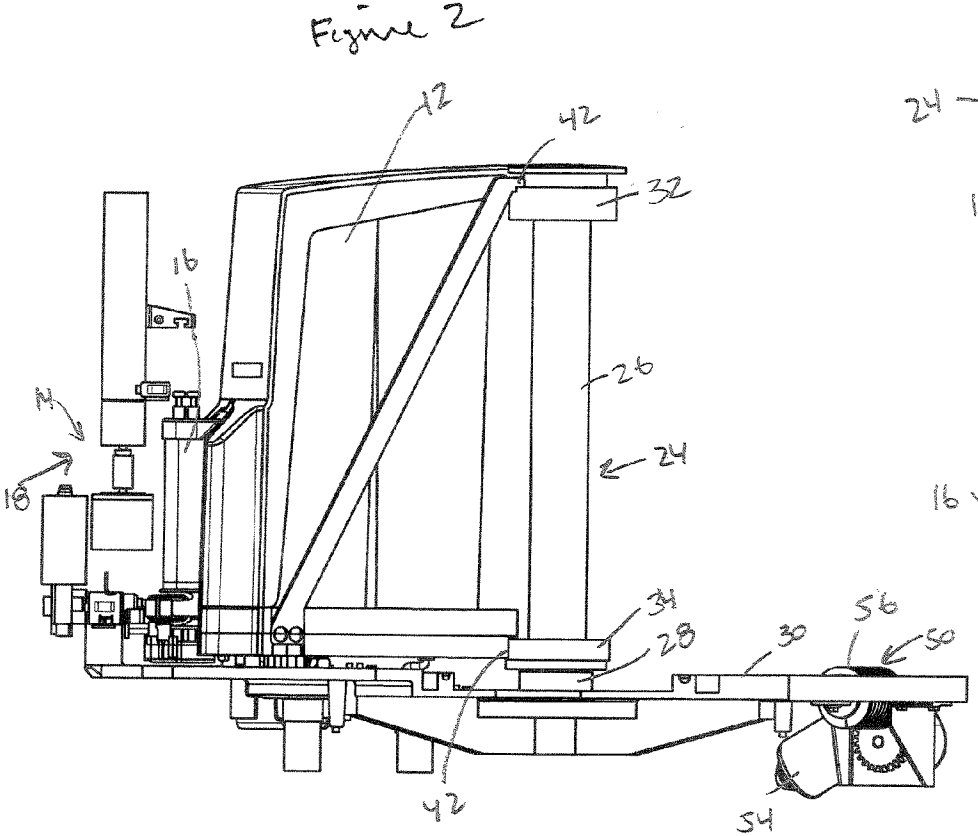
FIG. 2 is a partial cross-sectional view illustrating a canister segment supported on a central column.
Figure 5:
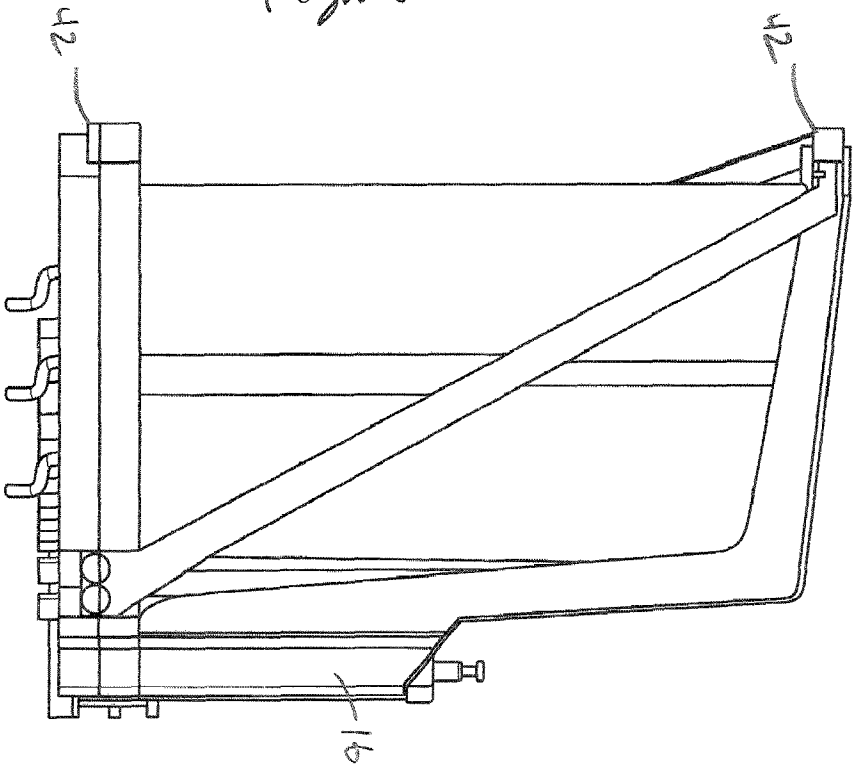
FIG. 5 is a side perspective view of the canister segment of FIG. 3.
Figure 4:
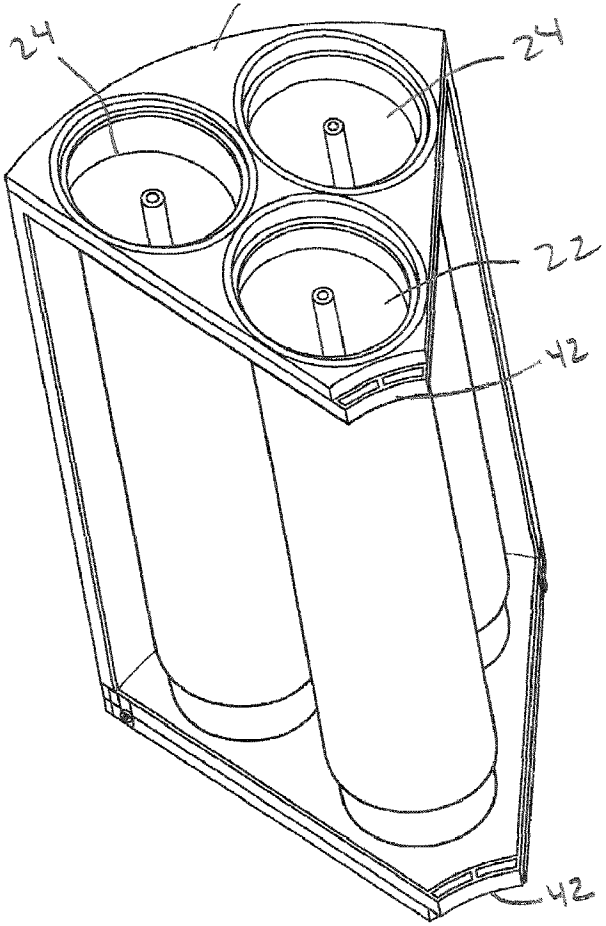
FIG. 4 is a rear perspective view of the canister segment of FIG. 3.

In the preferred embodiment, there is provided a total of six canisters 12. Referring now to FIGS. 3 and 4, each canister 12, in the preferred embodiment, is made of a one-piece molded plastic to form three cylindrical openings or receptacles 20. The three receptacles 20, in each canister 12, include one interior, or radially-inward, receptacle 22, and two exterior, or radially-outward receptacles 24. There are thus a total of six interior receptacles 20, and a total of twelve exterior receptacles 22. Each receptacle conventionally stores a specific fluid to be dispensed when formulating a particular color. The three receptacles 22 and 24 of each canister 12 form a triangular pattern or layout when viewed from the top.

As seen in FIG. 1, the imaginary centers of the receptacles preferably, but not requisitely, form the vertices of an equilateral triangle. Since each canister 12 may be made of a one-piece molded thermoplastic resin material, it is not only relatively inexpensive to make and replace, but it is also relatively lightweight. The containers for the colorants to be mixed consists of a series of identical, individual, separable, independently-mounted, wedge-shaped canisters 14.

Referring now to FIGS. 2 and 7-9, the basic support structure for the canisters 12 includes an upstanding, vertical mounting column assembly 24. The assembly 24 includes at least a column 26 supported on an upstanding hub 28 that is extending from a base plate 30. As described herein below, the base plate 30 is used to mount a driving mechanism, as well as the various components used at the dispensing station 14. Preferably, the base plate 12 with hub 20 is formed by an aluminum casting process, to form a one-piece unit.

The column 26 includes at least one rotatable bearing mount. Preferably, the column includes an upper bearing mount 32 and a lower bearing mount 34, positioned at opposite ends of the column 26. Each bearing mount includes an inner race 36 secured to the column 26 and includes an outer race 38 that is rotatable about ball bearings 40 in relation to the inner race 36. Each canister 12 is mounted to the outer race 38, such that the canisters 12 are able to rotate about the column 26.

Each canister 12 includes mounting hooks or brackets 42 positioned in lower and upper regions of the radially-inward side of the canister 12. The mounting brackets 42 are received in flanges 44 that are mounted to the outer race 38 to permit the canisters 12 to rotate about the column 26. Each canister 12 is, therefore, supported or suspended at its upper and lower ends in a cantilever-like fashion, wherein the series of canisters 12 are arranged circularly about the support column 24. Such a mounting arrangement allows for an easy and quick removal of any canister 12 and replacement thereof. Moreover, this mounting arrangement allows for a daisy-wheel type of operation of the apparatus where any canister may be located at a dispensing station 27 for measured or metered dispensing of its contents, as described hereinbelow. An important aspect of the invention is that a movable table is not required nor employed in the present invention.

Figure 6:
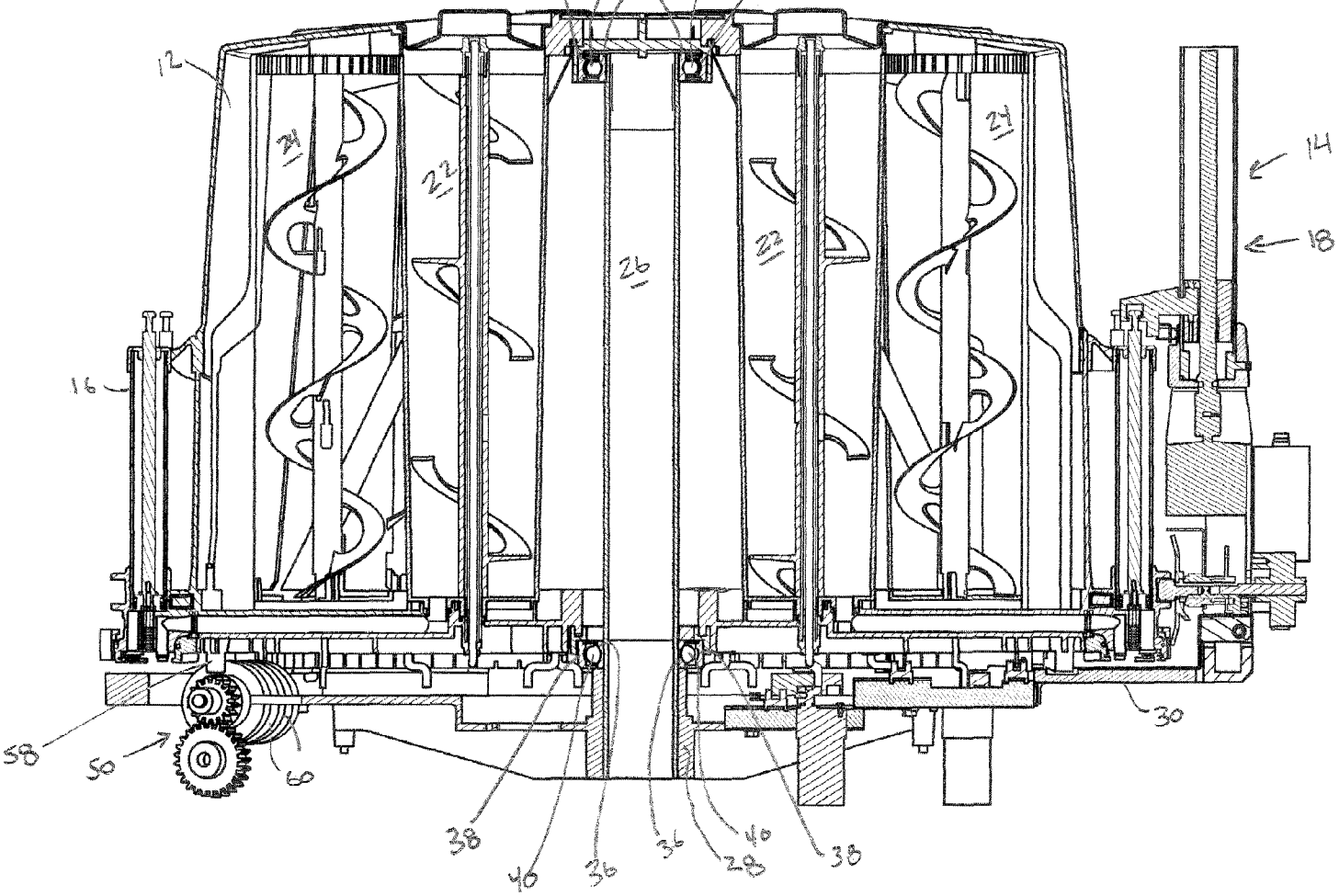
FIG. 6 is a cross-sectional view of the dispenser of FIG. 1.
Figure 7:
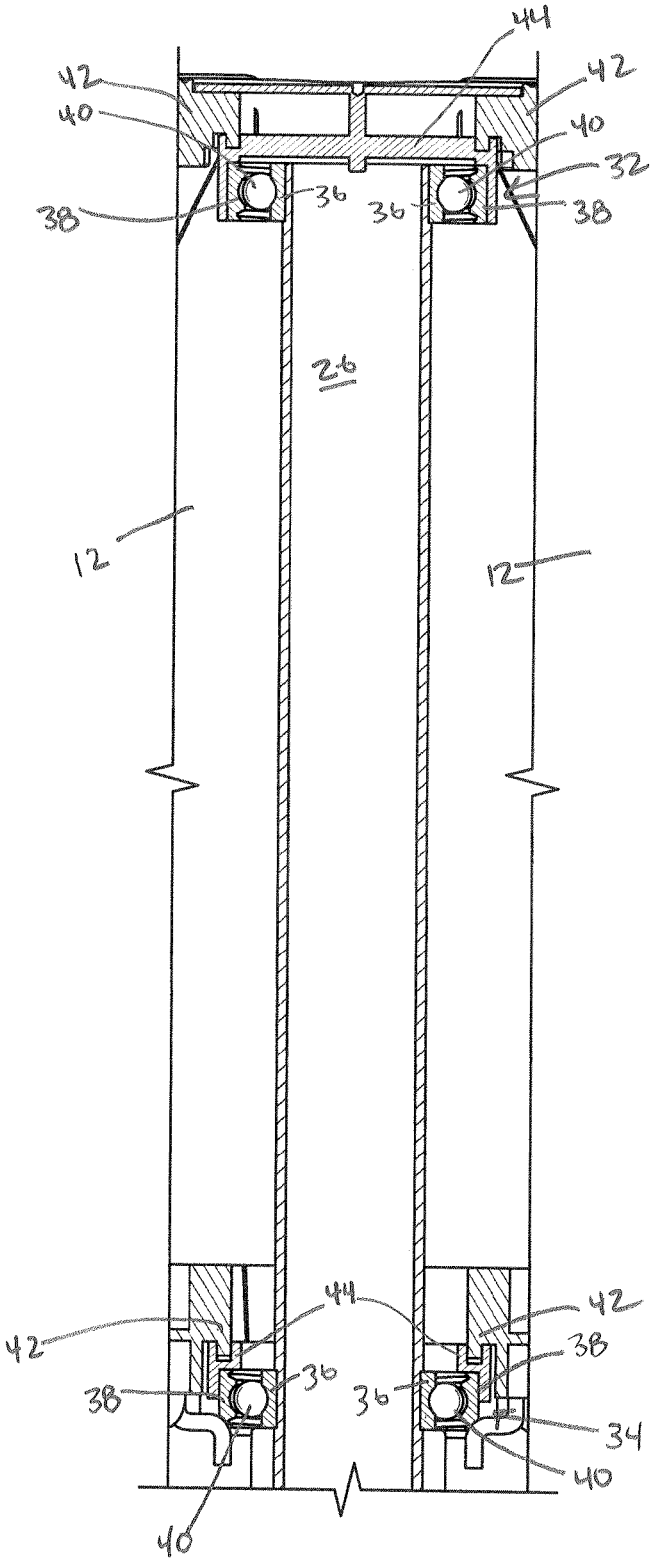
FIG. 7 is a sectional view of the central column.
Figure 8:
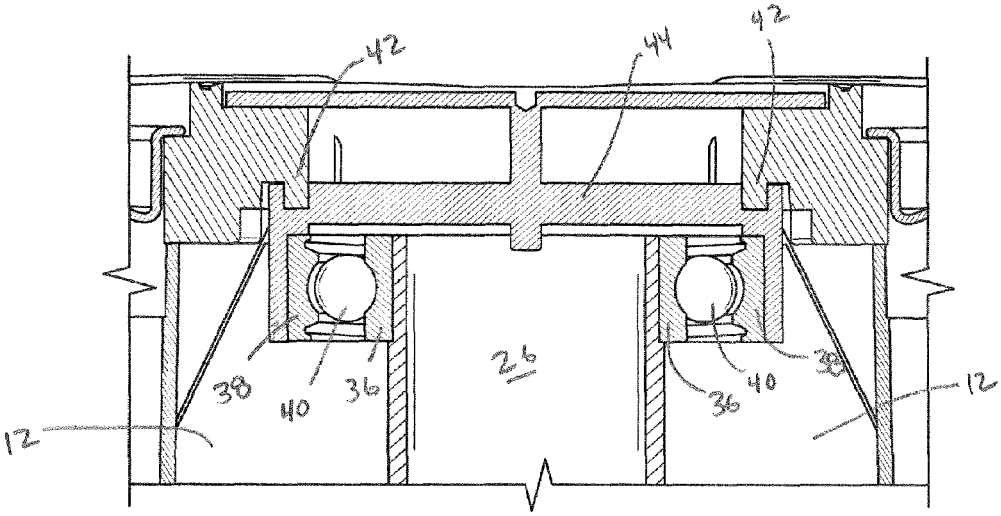
FIG. 8 is a sectional view of a top segment of the central column showing a top movable support mechanism for the canister.
Figure 9:
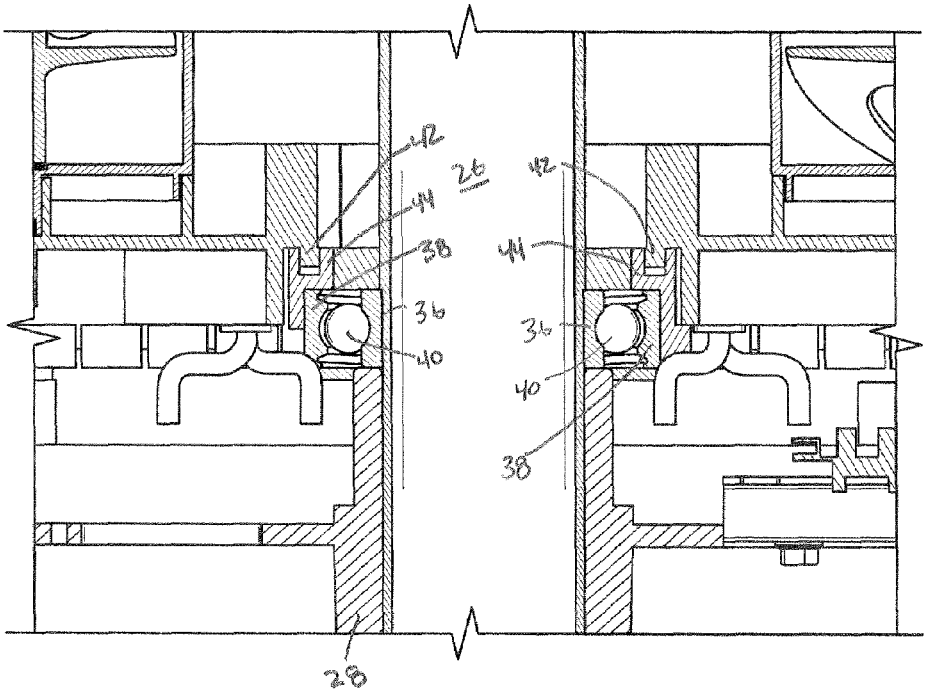
FIG. 9 is a sectional view of a bottom segment of the central column showing a bottom movable support mechanism for the canister.

To move the canisters such that a pump corresponding to a receptacle is positioned at the dispensing station, the present invention includes a drive mechanism 50. Best shown in FIGS. 1, 2, and 6, the drive mechanism 50 includes a drive motor 54 that drives a worm gear 56. The worm gear 56 engages a portion of one of the canisters 12. Preferably each canister 12 includes a plurality of cams 58 extending below each canister 12. The cams 58 are receivable in the grooves 60 of the worm gear 56. The length and pitch of the grooves 60 of worm gear 56 is such that there is always at least one cam 58 riding therein. When the worm gear 56 reaches the edge of two adjacent canisters at least one cam 58 from a first canister and at least one cam 58 of another adjacent canister are positioned and guided in the grooves 60 in order to ensure that the worm gear 56 is continuously engaged with a canister 12 to achieve the necessary indexing. The drive mechanism 50 is used for rotating the carousel of canister in either the clockwise or counterclockwise direction for locating and positioning a selected canister 12 at the dispensing station for purposes of dispensing fluid in the receptacle.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A dispenser apparatus comprising:

a plurality of dispensing units, each dispensing unit having a corresponding receptacle for holding a fluid and each corresponding receptacle having a pump for dispensing the fluid held in the corresponding receptacle;

a vertical mounting assembly for supporting said plurality of dispensing units;

a stationary dispensing station having a means for selectively actuating one of the pumps for dispensing the fluid held in said corresponding receptacle;

a mechanism for engaging at least a portion of one of the plurality of dispensing units, which when said mechanism is activated, the dispensing units are moved to align the pump on the corresponding receptacle to said stationary dispensing station, such that the fluid held in said corresponding receptacle is capable of being dispensed, and wherein the vertical mounting assembly includes a vertical support column and further includes a means for supporting at least an upper section of a radial inward side defined on said dispensing units, such that said dispensing units hang from said supporting means.

2. The dispenser of claim 1, wherein the means for supporting said radial inward side includes at least one flange secured to said column.

3. The dispenser of claim 1, wherein the means for supporting said radial inward side includes at least one rotatable bearing mount.

4. The dispenser of claim 3, wherein the rotatable bearing mount includes an inner race secured to the column, ball bearings, and an outer race that is rotatable about said ball bearings in relation to the inner race, and wherein said radial inward side of said dispensing units are mounted to said outer race, such that the dispensing units rotate about said column.

5. The dispenser of claim 1, wherein the mechanism for engaging at least a portion of one of the plurality of dispensing units includes a worm gear driven by a motor and each dispensing unit includes a base portion having cams for engagement with said worm gear.

6. A dispenser apparatus for dispensing fluids, wherein an improvement of the dispenser comprising:

a centrally located support column;

a plurality of canisters, each canister of the plurality of canisters, is cantilever mounted to said support column at least at an upper section defined thereby;

at least one flange attached to said support column and corresponding to said at least one mounting bracket such that said mounting bracket is positioned within said flange for supporting said canister; and at least one rotatable bearing mount corresponding to each flange, said rotatable bearing mount mounted to said support column and having a means for rotating canisters secured to said flange about said support column, and wherein said each canister, of the plurality of canisters, has a radially inward side, said radially inward side has at least one mounting bracket for mounting to said support column.

7. The dispenser of claim 6, wherein said means for rotating is defined by having an outer race, rotatable about an inner race, said inner race being secured to said support column and said flange being secured to said outer race.

8. The dispenser of claim 7 further comprising a mechanism for engaging at least a portion of a canister, of said plurality of canisters, which when said mechanism is activated, the canisters are moved about said column.

9. A dispenser apparatus for dispensing fluids, wherein an improvement of the dispenser comprising:

a centrally located support column;

a plurality of canisters, each canister of the plurality of canisters, is cantilever mounted to said support column at least at an upper section defined thereby; and a mechanism for engaging a portion of a canister, of said plurality of canisters, which when said mechanism is activated, the canisters are moved about said support column and wherein, the mechanism includes a worm gear for engaging a bottom portion of said canisters, and wherein said support column includes at least one annular flange rotatably attached to said column and each canister includes a bracket corresponding to said at least one annular flange and extending from a radial inward side defined on said canister wherein said brackets are mounted to said flange such that said canisters are cantilever mounted to said support column.

10. A dispenser apparatus comprising:

a centrally located vertically mounted column assembly;

a plurality of canisters, each canister, of the plurality of canisters, having a receptacle for holding a fluid and each receptacle includes a pump for dispensing the fluid held in a corresponding receptacle, each canister, of the plurality of canisters, being cantilever mounted to said column assembly at an upper section defined by said canisters;

a stationary dispensing station having a means for selectively actuating said pump for dispensing the fluid held in said corresponding receptacle; and a mechanism for engaging a portion of one of the plurality of canisters, which when said mechanism is activated, the plurality of canisters are moved to align the pump and corresponding receptacle to said stationary dispensing station, wherein the fluid held in said receptacle is capable of being dispensed, and wherein the mounting column assembly further includes a vertical column and at least one flange rotatably secured to said column and wherein each canister includes a corresponding bracket extending from a radial inward side defined on said canister, and said corresponding bracket is received by said flange and wherein the at least one flange is secured to a corresponding bearing mount secured to the column, the bearing mount having an inner portion secured to the column and having an outer portion rotatably secured to the inner portion such that when the canister moves, flange rotates with the outer portion of the bearing mount to rotate about the column.

11. The dispenser of claim 10 wherein said mechanism for engaging a portion of one of the plurality of canisters includes a worm gear defined to engage a cam extending from a bottom portion of a canister.

* * * * *